United States Patent [19]

Weers

[11] Patent Number: 5,035,720

[45] Date of Patent: Jul. 30, 1991

[54] COMPOSITION FOR INHIBITION OF CORROSION IN FUEL SYSTEMS, AND METHODS FOR USE AND PREPARATION THEREOF

[75] Inventor: Jerry J. Weers, Ballwin, Mo.

[73] Assignee: Petrolite Corporation, St. Louis, Mo.

[21] Appl. No.: 252,301

[22] Filed: Oct. 3, 1988

Related U.S. Application Data

[63] Continuation-in-part of Ser. No. 159,861, Feb. 24, 1988, abandoned.

[51] Int. Cl.[5] ..... C10L 5/00

[52] U.S. Cl. ..... 44/343

[58] Field of Search ..... 44/72, 63, 343

[56] References Cited

U.S. PATENT DOCUMENTS

| | | | |
|---|---|---|---|
| 3,641,046 | 2/1972 | Gates, Jr. et al. | 44/63 |
| 3,791,803 | 2/1974 | Andress, Jr. | 44/63 |
| 3,843,337 | 6/1971 | Korpics | 44/63 |
| 3,907,517 | 9/1975 | Minagawa et al. | 44/63 |
| 4,197,210 | 4/1980 | Bridges | 252/50 |
| 4,257,779 | 3/1981 | Sung et al. | 44/63 |
| 4,263,015 | 4/1981 | Sung et al. | 44/63 |
| 4,282,008 | 8/1981 | Sung | 44/63 |
| 4,294,585 | 9/1980 | Sung | 44/63 |
| 4,629,579 | 12/1986 | Jessup et al. | 252/33.6 |
| 4,647,289 | 3/1987 | Reid | 44/57 |

OTHER PUBLICATIONS

Chem. Abstr., 84:62205p, by M. H. Milnes, vol. 84, 1976, p. 167.

Chem. Abstr., 88:25475p, by Kazutada Mitamura and Hideo Yokota, vol. 88, 1978, p. 139.

*Primary Examiner*—Margaret B. Medley

*Attorney, Agent, or Firm*—Stanley M. Tarter; Jeffrey S. Boone

[57] ABSTRACT

A composition adapted for use as a corrosion inhibitor in petroleum-based fuel. The composition comprises an oil-soluble adduct of a triazole and a basic nitrogen compound selected from the group consisting of polyamines, alkoxyamines, aryloxyamines and monoalkyleneamines. Methods for preparation and use of such compositions are also disclosed. In addition, a petroleum-based fuel composition of reduced tendency to corrode copper and aluminum surfaces contacted by the fuel composition is disclosed. The composition comprises a petroleum-based fuel and an oil-soluble adduct of a triazole and a basic nitrogen compound.

19 Claims, No Drawings

COMPOSITION FOR INHIBITION OF CORROSION IN FUEL SYSTEMS, AND METHODS FOR USE AND PREPARATION THEREOF

CROSS-REFERENCE TO RELATED APPLICATION

This is a continuation-in-part of co-pending U.S. patent application Ser. No. 159,861, filed on Feb. 24, 1988, now abandoned.

BACKGROUND OF THE INVENTION

1. Field of the Invention

This invention relates to compositions and methods for inhibiting corrosion of copper and aluminum surfaces in fuel systems, and more particularly to such compositions and methods for inhibiting corrosion of copper and aluminum surfaces in petroleum-based fuel systems which contain elemental sulfur or sulfur-containing compounds, such as mercaptans.

2. Prior Art

A problem commonly encountered during production, storage and handling of many petroleum-based fuels is corrosion of copper and aluminum surfaces contacted by the fuel. Such corrosion is undesirable not only because of the resulting deterioration of such surfaces, but also because aluminum and copper particles are thereby released into the fuel, tending to exacerbate degradation of the fuel. The copper corrosion is known to be encouraged by presence in the fuel of sulfur in elemental or compound form. Moreover, the problem of corrosion has been aggravated recently by increased use of fuels containing alcohol additives such as ethanol. Alcohol/fuel mixtures, such as "gasohol", tend to absorb and retain higher concentrations of water than does alcohol-free petroleum-based fuel, thereby increasing the rate of corrosion, particularly of aluminum.

Conventionally, thiadiazole derivatives have been incorporated into fuel and other systems to inhibit corrosion of metal surfaces in the system. Such corrosion inhibitors generally have been effective in inhibiting corrosion caused or enhanced by the presence of certain sulfide-type sulfur-containing compositions, such as hydrogen sulfide, in fuel and other systems. However, such inhibitors have been found to be less effective against corrosion catalyzed by the presence of elemental sulfur and sulfur-containing compounds such as mercaptans. Many commercially available fuels, such as diesel fuel, jet fuel and gasoline, tend to contain significant concentrations of elemental sulfur and mercaptans, while such fuels generally tend not to contain significant concentrations of the sulfide-type compositions to which the prior art inhibitors are directed. Sulfide-type compositions are substantially removed from the fuel during standard refinement and processing of the fuel. Accordingly, the inadequacy of the commercial inhibitors in inhibiting copper or aluminum corrosion resulting from elemental sulfur and mercaptans is a serious drawback.

Benzotriazole has been used as a corrosion inhibitor in aqueous systems. For example, as noted in Chem. Abstr. 88:25475p, benzotrizole and mercaptobenzothiazole have been employed in aqueous ethylene glycol solutions to inhibit corrosion on certain surfaces exposed to such antifreeze solutions. In view of the relative insolubility of benzotrizole in oil, its use generally has been limited to aqueous systems. However, benzotrizole has been incorporated in combination with a higher fatty amide of a polybasic amine in leaded gasoline to inhibit corrosion of lead containers. See Chem. Abstr. 84:62205p.

Aside from the oil-insolubility limitation, benzotriazole also has been found to be undesirable as a corrosion inhibitor in fuel systems for several other reasons. Incorporation of benzotriazole into fuel tends to darken the fuel; and dark fuels are viewed by many customers as undesirable. In addition, water tends to separate out of fuel held in storage tanks, thereby forming a water/fuel two-phase system. Since benzotriazole has a higher water solubility than oil solubility, it tends to separate out of the fuel and into the water phase, thereby limiting its effectiveness in inhibiting corrosion of surfaces contacted by the fuel.

U.S. Pat. No. 4,197,210 describes the use of an adduct of benzotriazole with dialkylene amines in lubricating oils. In such oils, corrosion problems typically result from the presence of sulfide-type compositions included in the lubricating oil for a variety of functions, including anti-oxidant, lubricity, and high-pressure wear functions.

Accordingly, a need has existed for oil-soluble fuel additives which inhibit copper and aluminum corrosion caused or enhanced by the presence of elemental sulfur or mercaptans, and for such additives which will not turn fuel dark or tend to separate out of fuel in a fuel/water two phase system.

SUMMARY OF THE INVENTION

Briefly, therefore, the present invention is directed to a novel composition adapted for use as a corrosion inhibitor in fuel. The composition comprises an oil/soluble adduct of a triazole and a basic nitrogen compound selected from among polyamines, alkoxyamines, aryloxyamines, and monoalkyleneamines.

The present invention is further directed to a petroleum-based fuel composition of reduced tendency to corrode copper and aluminum surfaces contacted by the fuel composition. The fuel composition comprises a petroleum-based fuel and an oil-soluble adduct of a triazole and a basic nitrogen compound.

The present invention is also directed to a method for preparing a copper or aluminum corrosion inhibitor adapted for use in petroleum-based fuel. The method comprises the step reacting a triazole with a basic nitrogen compound in a molar proportion of between about 0.9:1 and about 1:0.9.

The present invention is further directed to a method for inhibiting copper and aluminum corrosion in a petroleum-based fuel system comprising the step of adding to fuel a corrosion inhibitor comprising the oil-soluble adduct of a triazole and a basic nitrogen compound.

Among the several advantages found to be achieved by the present invention, therefore, may be noted the provision of an oil-soluble corrosion inhibitor for fuel that is effective against copper and aluminum corrosion; the provision of such inhibitor which is effective against corrosion caused or enhanced by the presence of elemental sulfur or mercaptans; the provision of such inhibitors which avoid darkening fuel; the provision of such inhibitors which do not tend to separate out of the fuel phase of a water/fuel two-phase system; the provision of a method for preparation of such inhibitors; and the provision of a method for inhibiting copper or aluminum corrosion caused or enhanced by elemental sulfur or mercaptans in fuel systems.

DESCRIPTION OF THE PREFERRED EMBODIMENTS

In accordance with the present invention it has been discovered that incorporation into petroleum-based fuel of an oil-soluble adduct of a triazole and a water-insoluble basic nitrogen compound inhibits corrosion of copper and aluminum surfaces which corrosion would otherwise be enchanced or caused by the presence of elemental sulfur or mercaptans in the fuel. It has been found that although benzotriazole and related triazoles are relatively insoluble in petroleum-based fuel, certain adducts of such triazoles display highly increased oil solubility. Accordingly, not only can the adducts be dissolved in fuel, but the adducts resist separation out of the fuel phase and into a water phase of a fuel/water two-phase system as commonly develops in storage tanks such as those found at gasoline service stations. Moreover, it has been found that the adducts do not tend to turn fuel dark as does benzotriazole. As used herein, what is meant by the term water insoluble is that an aqueous mixture of about 1000 ppm of the composition in question is hazy or cloudy in appearance or is an emulsion. On the other hand, by oil soluble, what is meant is that the composition is miscible with oil in a concentration of at least about 100 ppm of the composition.

Without being bound to any particular theory, it is believed that the benefits of the adducts of this invention are achieved in the following manner. Sulfur compounds such as hydrogen sulfide tend to attack a copper or aluminum surface and corrode the surface relatively rapidly. Thus, prior art compositions are believed to inhibit corrosion of copper or aluminum surfaces related to sulfide-type sulfur containing compositions by migrating and adhering to the copper or aluminum surfaces more quickly than does the sulfur compound, thereby forming a barrier between the surface and the sulfide. Accordingly, a primary goal of selecting a composition to inhibit such corrosion is to find an inhibitor which can coat the surface as quickly as possible. However, corrosion related to the presence of elemental sulfur or mercaptans develops more slowly than sulfide induced corrosion. Nevertheless, while elemental sulfur or mercaptan related corrosion attacks the surface more slowly, with time they attack the surface more severely than do sulfides. Accordingly, the quickly-laid coatings produced by prior art compositions have been found to be insufficient to effectively prevent corrosion related to elemental sulfur and mercaptans. Such ineffectiveness is especially pronounced in fuel systems where, due to earlier refining steps, hydrogen sulfide is usually absent, but where elemental sulfur, mercaptans and water are present. Therefore, a different problem is raised by elemental sulfur and mercaptan type corrosion than by sulfide-type corrosion, and a different kind of inhibitor must be employed.

It has been found that whereas benzotriazole and its common salts such as potassium, sodium, and ammonium salts are not oil soluble, adducts of triazole and water-insoluble nitrogen compounds are oil-soluble. Without being bound to any particular theory, it is believed that the adducts of this invention inhibit corrosion caused by elemental sulfur or mercaptans by forming a protective coating over copper and aluminum surfaces contacted by fuel containing these adducts. It is believed that the carbon chain of the amine, along with the triazole is incorporated into the film at the metal surface, thereby building a coating superior to the coatings formed by prior art compositions.

U.S. Pat. No. 4,197,210 discloses the use of certain adducts of benzotriazole and dialkylene amines in lubricating oil to inhibit copper and steel corrosion. However, in view of the high concentrations of adduct shown in that patent to be necessary for corrosion inhibition and the fact that the corrosion of surfaces exposed to lubricating oil results from sulfide type additives, it would appear that the concentration of such adducts in fuel necessary for effectiveness would be too high to be useful in fuel, and that such adducts are inapplicable to elemental sulfur and mercaptan type corrosion. Application of such adducts at concentrations disclosed in the patent, generally at least 200 ppm, would be expected to cause plugging of ejectors, and other deleterious side effects, including formation of carburetor deposits. In addition, not only would use of such large amounts of the adducts be costly, but certain petroleum-based fuels tend to contain different types of sulfur compositions with different corrosion characteristics than the sulfur compositions present in lubricating oil, and even larger concentrations would be expected to be necessary in application to fuel systems as compared to lubricating oil systems.

Further, since the adducts of patent '210 are shown therein as useful for copper and steel corrosion inhibition in sulfide type systems, there is no suggestion that they would be applicable to aluminum corrosion inhibition or to elemental sulfur and mercaptan type systems. Nevertheless, surprisingly, it has been found that low concentrations of adducts of certain triazoles and certain nitrogen compounds are effective in fuel systems wherein elemental sulfur or mercaptans is present. This advantage is particularly surprising in view of the fact that such adducts generally exhibit inferior sulfide-type corrosion inhibition. Moreover, whereas patent '210 discloses adducts of benzotriazole and dialkylene amines particularly useful in the systems of concern therein, it has now been discovered that other triazoles, particularly tolyltriazole and certain other amines such as polyamines, alkoxyamines, aryloxyamines, and monoalkyleneamines are not only useful in fuel systems, but in many cases are superior in cost or effectiveness to adducts of benzotriazole and dialkylene amine.

Compositions of this invention may be prepared in the following manner. A water-insoluble basic nitrogen compound, preferably an amine, is heated to between about 70° C. and 100° C., preferably about 80° C. Generally, it has been found that employment of almost any oil-soluble basic nitrogen compound will produce an effective adduct. Amines with enough carbon atoms, generally at least about 6 carbon atoms, to give an oil-soluble product are particularly useful. Moreover, it is preferred that the amine be water-insoluble to avoid emulsion formation or extraction of the amine or the inhibitor produced therefrom into the water phase. Thus, for example, bis(2-hydroxyethyl)-oleylamine, alkoxyamines such as oxyalkylated fatty amines, including cocoamines and oleylamines, as well as other oxyalklylated amines such as oxyalklylated 2-ethyl-hexylamine and oxyalkylated ether amines are appropriate. Alkoxy amines and aryloxy amines, preferably alkoxy amines such as ethoxy amines, have been found to achieve slightly better results than other nitrogen compounds. It has been noted that amines that have been alkoxylated, particularly oxyethylated, with from about 2 moles alkoxy (ethoxy) to about 15 moles alkoxy (ethoxy) achieve superior results. Use of above about 15 moles ethoxy has been found to result in an adduct which is generally too highly water-soluble.

A triazole, preferably an aryltriazole such as benzotriazole or tolyltriazole, most preferably tolyltriazole, is added to the warm amine. The triazole is added in an amine to triazole molar ratio of from about 0.9:1 to about 1:0.9, preferably about 1:1. The upper and lower limits of the amine to triazole ratio are restrained by the following considerations. Since the triazole as typically available is a solid, an excess of triazole, i.e., an amine to triazole molar ratio less than 1, results in unreacted solids remaining in the reaction mixture. On the other hand an excess of amine tends to be wasteful in employment of excess amine which remains unreacted.

The triazole is added to the amine slowly, such as over a thirty minute period, so that the solid triazole will dissolve as added and therefore, will not collect as solid precipitate. The reaction mixture is stirred and maintained at between about 70° C. and about 100° C., preferably at about 80° C., until the reaction mixture becomes a light yellow viscous oil-like composition. While the reaction can progress at temperatures below about 70° C., the rate of reaction is significantly decreased.

The reaction is typically run neat, but upon completion of the reaction, if desired, an aromatic solvent or kerosene, may be added to the reaction mixture. About 10% by weight of the solvent based on total composition improves handling properties under certain conditions. For example, addition of the solvent maintains the composition's rheological properties in very cold weather. It is believed that any aryltriazole group, whether unsubstituted, or mono-, di- or trisubstituted, on the triazole is acceptable.

The adducts, as prepared by the above procedure, may then be added directly to fuel. Generally it has been found that between about 5 ppm and 100 ppm, preferably between about 10 ppm and about 20 ppm, effectively inhibits corrosion of copper surfaces and between about 5 ppm and about 1000 ppm effectively inhibits corrosion of aluminum surfaces. The tendency of fuel treated in such manner to corrode exposed copper or aluminum surfaces has been found to be significantly reduced as compared to untreated fuel.

The following examples illustrate the invention.

EXAMPLE 1

A series of test tubes containing kerosene and 3 ppm elemental sulfur and a series of test tubes containing kerosene and 20 ppm elemental sulfur were prepared. A sample of additive was added to each test tube to produce a mixture of additive concentration as set forth in the table below. The Additive numbers throughout the working examples correspond to the following numbers:

| Additive No. | Additive |
|---|---|
| 1 | Product of 1:1 Primeen 81R* and formaldehyde reaction |
| 2 | Polymer of diethylene glycol dimethacrylate and isodecyl methacrylate with 2,5 dimercapto-1,3,4-thiadiazole in a 1:1 molar ratio with AIBN catalyst |
| 3 | Product of n-octenyl succinic anhydride, ethylenediamine and carbon disulfide |
| 4 | Product of glycine and ethylisothiocyanate |
| 5 | Salt of Texaco M-600** amine composition and formaldehyde |
| 6 | Product of 1:1 oleylamine/formaldehyde reaction product reacted with Additive 16 |
| 7 | Salt of Texaco M-600** amine composition and benzaldehyde |
| 8 | Salt of Texaco D-400 (i.e, $H_2N—CH(CH_3)CH_2—OCH_2CH(CH_3)_n—NH_2$, MW = 400) |
| 9 | Salt of Texaco M-600** amine composition and salicylaldehyde in 1:1 proportion |
| 10 | Salt of Texaco M-600** and thiadiazole in 1.1 proportion |
| 11 | Salt of n-butylisothiocyanate and hydrazine hydrate in 1:1 proportion |
| 12 | Substituted 2-thiohydantoin |
| 13 | T-301 sweetener which acts as an oxidizing agent |
| 14 | T-727 sweetener which acts as an oxidizing agent |
| 15 | Polymer of diethylene glycol dimethacrylate and isodecyl methacrylate with 2,5 dimercapto-1,3,4-thiadiazole in a 1:1 molar ratio |
| 16 | 2,5 dimercapto-1,3,4-thiadiazole |
| 17 | Elco 461 thiodiazole |
| 18 | Amoco 153 thiodiazole |
| 19 | Amoco 158 thiodiazole |
| 20 | Product of Texaco M-600** and isobutyraldehyde reaction product and thiadiazole |

*A branched tertiary aliphatic amine mixture sold by Rohm and Haas
**$CH_3OC_2H_4O[CH_2CH(CH_3)O]_8CH_2CH(CH_3)NH_2$ Additives numbers 21 and 22 are tolyltriazole/amine adducts of this invention. In particular, Additive Number 21 is 1:1 adduct of tolyltriazole and bis(2-hydroxyethyl)oleylamine and Additive number 22 is 1:1 adduct of tolyltriazole and bis(2-hydroxyethyl)cocoamine. Copper strips were placed in the test tubes for three hours at about 100° C. in accordance with the ASTM D-130 procedures and the ASTM D-130 ratings listed in the table below were recorded.

| | 3 ppm S° | | | | | 20 ppm S° | | | | |
|---|---|---|---|---|---|---|---|---|---|---|
| Additive | 50 ppm | 25 ppm | 10 ppm | 5 ppm | 0 ppm | 100 ppm | 50 ppm | 25 ppm | 10 ppm | 0 ppm |
| None | | | | | 3A<br>3B<br>3A | | | | | 4A |
| 1 | 1B | 1B | 2B | | | 2C | 3B | 4A | 4A | |
| 2 | 1A | 1A | 1B | 1B<br>2B | | 1A | 1B | 4A<br>1B | | |
| 3 | 1B | | | | | 4B | 4A | 4A | | |
| 4 | 1A | 1A | 1B | 2B | | 1B | 2A | 4A | | |
| 5 | 1B | 2C | 2B | | | 2C | 3B | 4A | 4A | |
| 6 | 1B | 1B | 2C | | | 2C | 3B | | 4A | |
| 7 | 1B | 2B | 2B | | | 2C | 3B | 4A | 4A | |
| 8 | 2C | 2B | 2B | | | 4A | 4A | 4A | 4A | |
| 9 | 1B | 2B<br>3B | | | | | 1B | 2B | 4A | |

-continued

| | 3 ppm S° | | | | | 20 ppm S° | | | | |
|---|---|---|---|---|---|---|---|---|---|---|
| Additive | 50 ppm | 25 ppm | 10 ppm | 5 ppm | 0 ppm | 100 ppm | 50 ppm | 25 ppm | 10 ppm | 0 ppm |
| 10 | 1B | 1B | 2C | | 2C | 4A | 4A | 4A | | |
| 11 | | 4A | 2C | | 4A | 4A | | | | |
| 12 | | 1A | 1B | | 3B | 3B | | | | |
| 13 | | | | | 3B | 4A | 4A | | | |
| 14 | | | | | 4A | 4A | 4A | | | |
| 15 | | 1A | 1B | 1B | 1A | 1A | | | | |
| 16 | 1B | 1B | 1B | | 2A | 1B | 1B | 4A | | |
| 17 | 1B | 1B | 2C | | 1B | 2A | 4A | 4A | | |
| 18 | 1B | 1B | 3A | | | | | | | |
| 19 | | 1A | 2B | | 2C | 3B | | | | |
| 20 | | | | | 4A | 3B | 4A | 4A | | |
| 21 | 1A | 1A | | | 1A | 1A | | | | |
| 22 | 1A | 1A | | | 1A | 1A | | | | |

The ratings corresponds to the following descriptions of the appearance of the copper strip:

| Rating | Description |
|---|---|
| 1A | Slight tarnish. Light orange, almost the same as a freshly polished strip. |
| 1B | Slight tarnish. Dark orange. |
| 2A | Moderate tarnish. Claret red. |
| 2B | Moderate tarnish. Lavender. |
| 2C | Moderate tarnish. Multicolored with lavender blue or silver, or both, overlaid on claret red. |
| 2D | Moderate tarnish. Silvery. |
| 2E | Moderate tarnish. Brassy or gold. |
| 3A | Dark tarnish. Magenta overcast on brassy strip. |
| 3B | Dark tarnish. Multicolored with red and green showing (peacock), but no gray. |
| 4A | Corrosion. Transparent black, dark gray or brown with peacock green barely showing. |
| 4B | Corrosion. Graphite or lusterless black. |
| 4C | Corrosion. Glossy or jet black. |

EXAMPLE 2

Procedures similar to those of Example 1 were followed to test various aluminum corrosion inhibitors. The fuel in the test tubes was 90% leaded gasoline, 10% ethanol. The aluminum strips were stored in the test tubes for 100 hours at 70° C. The corrosion of the aluminum strips was graded from 0, corresponding to no corrosion, to 10, corresponding to heavy discoloration and pitting of the aluminum strip. Additive number 23 is a 1 adduct of 2-mercaptobenzothiazole and Exxon's Tomah E-14-2 (an oxyalkylated ether amine corresponding to a compound which has a 10 carbon branched group attached to $—0(CH_2)_3N—(CH_2OH)_2$). Additive numbers 24 and 25 are adducts of this invention, namely an adduct of tolyltriazole and Tomah E-14-2 and an adduct of benzotriazole and tetraethylene pentamine, respectively. Additive numbers 26 and 28 are amines, specifically Tomah E-14-2 and Tomah AO-14-2, respectively, and Additive number 27 is imidazoline, sold by Petrolite under the trademark KP-111. Tomah AO-14-2 is an amine oxide of Tomah E-14-2. The following results were obtained. With respect to Additive numbers 26 and 28, it is noted that amines by themselves are not typically used as additives, but are included for comparison of the efficacy of the adducts with that of their substrates.

| Additive Additive | Additive Concentration (ppm) | Active Concentration (ppm) | Rating |
|---|---|---|---|
| None | — | — | 10 |
| 23 | 1500 | 1500 | 0 |
| 23 | 3000 | 3000 | 1-2 |
| 24 | 1500 | 1500 | 1-2 |
| 24 | 3000 | 3000 | 0 |
| 25 | 1500 | 990 | 0 |
| 25 | 3000 | 1975 | 0 |
| 26 | 1500 | 1500 | 2-3 |
| 26 | 3000 | 3000 | 3-4 |
| 27 | 1500 | 1400 | 0 |
| 27 | 3000 | 2800 | 10 |
| 28 | 1500 | 750 | 7-8 |
| 28 | 3000 | 1500 | 0 |
| Competitive Additive | 1500 | Unknown | 0 |

EXAMPLE 3

The procedures of Example 1 were followed to test the effect of varying the relative proportions of triazole and nitrogen compound. The fuel was kerosene with 20 ppm elemental sulfur. Additives 29-34 were adducts of the following:

Additive:

| | |
|---|---|
| 29 | 206:100:31 by weight bis(hydroxyethyl)cocoamine/tolyltriazole/Solvent #14(xylene-type) |
| 30 | 35:13 by weight bis(hydroxyethyl)octadecylamine/tolyltriazole |
| 31 | 21.2:13 by weight bis(hydroxyethyl)2-ethylhexylamine/tolyltriazole |
| 32 | 12.6:13 by weight 2-ethylhexylamine/tolyltriazole |
| 33 | 77.2:13 by weight poly(15)ethoxylated 2-ethylhexylamine/tolyltriazole |
| 34 | tolyltriazole |

The following ASTM D-130 ratings were obtained:

| Additive | Additive Concentration (ppm) | Rating (3 hrs) | Rating (6 hrs) |
|---|---|---|---|
| None | — | 4A | 4A |
| 29 | 20 | 1A | — |
| | 10 | 1A | 1B |
| 30 | 20 | 1A | — |
| | 10 | 1A | 1B |
| 31 | 20 | 1A | — |
| | 10 | 1A | 1B |
| 32 | 20 | 1A | — |
| | 10 | 1A | 2E |
| 33 | 20 | 1A | — |

-continued

| Additive | Additive Concentration (ppm) | Rating (3 hrs) | Rating (6 hrs) |
|---|---|---|---|
| | 10 | 1A | 2E |
| 34 | 3 | 2E | — |
| | 10 | 1A | 2A |

EXAMPLE 4

By the procedures of Example 1, the corrosive effects of various concentrations of elemental sulfur in combination with various concentrations of various additives on copper were measured. The ASTM D-130 ratings after 3 hours at 100° C. are listed below.

| S° Concentration (ppm) | Additive | Additive Concentration (ppm) | Rating |
|---|---|---|---|
| 20 | None | — | 3B |
| 20 | 21* | 100 | 1A |
| 20 | 21* | 50 | 1A |
| 20 | 22* | 100 | 1A |
| 20 | 22* | 50 | 1A |
| 3 | None | — | 3B |
| 3 | 21* | 25 | 1A |
| 3 | 21* | 10 | 1A |
| 3 | 22* | 25 | 1A |
| 3 | 22* | 10 | 1A |
| 20 | 9 | 100 | 3A |
| 3 | 9 | 10 | 3B |
| 20 | 15 | 100 | 1A |
| 20 | 15 | 50 | 1A |
| 20 | 15 | 25 | 1A |
| 3 | None | — | 3B |
| 3 | 15 | 25 | 1A |
| 3 | 15 | 10 | 1B |
| 3 | 15 | 5 | 1B |
| 20 | 2 | 50 | 1B |
| 20 | 2 | 25 | 1B |
| 3 | 2 | 10 | 1B |
| 3 | 2 | 5 | 1B |

*Additives of this invention

In the following trials, the same procedures were followed, but hydrogen sulfide was added to the kerosene in place of the elemental sulfur. Additive number 35 is an adduct of 2-mercaptobenzothiazole, Texaco's amine composition M-600 (identified in Example 1) and isobutyraldehyde.

| $H_2S$ Concentration (ppm) | Additive | Additive Concentration (ppm) | Rating |
|---|---|---|---|
| 5 | 2-Mercaptobenzothiazole | 250 | 3A |
| 5 | 35 | 250 | 3A |
| 5 | 15 | 250 | 3A |
| 5 | 13 | 250 | 3A |

EXAMPLE 5

The procedure of Example 1 was followed except that in this example, 100 ppm elemental sulfur was contained in a paraffinic base oil. The following ASTM D-130 ratings were obtained at 122° C. over a 24-hour period.

| Additive | ppm | Rating 1 hr. | 5 hr. | 20 hr. | 24 hr. |
|---|---|---|---|---|---|
| none | — | 4A | 4A | 4C | 4C |
| 29 | 100 | 4A | 4A | 4A | 4A |
| | 250 | — | — | — | 1B |
| | 500 | 1A | 1A | 1B | 1B |
| 30 | 100 | 4A | 4A | 4C | 4C |
| | 250 | — | — | — | 1B |
| | 500 | 1A | 1A | 1B | 1B |
| 31 | 100 | 4A | 4A | 4C | 4C |
| | 250 | — | — | — | 1B |
| | 500 | 1A | 1A | 1B | 1B |
| 32 | 100 | 3A | 3A | 3A | 3A |
| | 250 | — | — | — | 3B |
| | 500 | 1A | 2C | 3A | 3A |
| 33 | 100 | 4A | 4A | 4A | 4A |
| | 250 | — | — | — | 4A |
| | 500 | 2C | 2C | 3B | 3B |

EXAMPLE 6

The procedure of Example 5 was followed except that in this example 200 ppm of 1-methylpropanethiol instead of elemental sulfur was contained int he paraffinic base oil. The following ASTM D-130 ratings were obtained at 122° C.

| Additive | ppm | Rating 1 hr. | 24 hr. |
|---|---|---|---|
| none | — | 1A | 3B |
| 29 | 100 | 1A | 2E |
| | 250 | 1A | 1A |
| | 500 | 1A | 1A |
| 30 | 100 | 1A | 3A |
| | 250 | 1A | 1A |
| | 500 | 1A | 1A |
| 31 | 100 | 1A | 2C |
| | 250 | 1A | 1B |
| | 500 | 1A | 1B |
| 32 | 100 | 1A | 3A |
| | 250 | 1A | 1B |
| | 500 | 1A | 3A |

In view of the above, it will be seen that the several objects of the invention are achieved and other advantageous results obtained.

As various changes could be made in the above compositions and methods without departing from the scope of the invention, it is intended that all matter contained in the above description shall be interpreted as illustrative and not in a limiting sense.

What is claimed is:

1. A petroleum-based fuel composition of reduced tendency to corrode copper and aluminum surfaces contacted by the fuel composition, comprising a petroleum-based fuel and a corrosion inhibiting amount of oil-soluble adduct of a triazole and a basic nitrogen compound selected from the group consisting of polyamines, alkoxyamines, aryloxyamines and aryloxyamines, said adduct being resistant to extraction from an oil phase to a water phase.

2. A fuel composition as set forth in claim 1 wherein said triazole is selected from the group consisting of benzotriazole and tolyltriazole.

3. A fuel composition as set forth in claim 1 wherein said nitrogen compound is a water-insoluble amine.

4. A fuel compositions as set forth in claim 1 wherein said composition comprises from about 5 ppm to about 100 ppm of said adduct.

5. A method for preparation of a copper or aluminum corrosion inhibitor adapted for use in petroleum-based fuel, comprising the step of reacting a triazole with a basic nitrogen compound in a molar proportion of between about 0.9:1 and about 1:0.9 to produce an oil-soluble adduct that is resistant to separation from an oil phase to a water phase, said nitrogen compound being selected from the group consisting of polyamines, alkoxyamines and aryloxyamines.

6. A method as set forth in claim 5 wherein said triazole is selected from the group consisting of benzotriazole and tolyltriazole.

7. A method as set forth in claim 5 wherein said nitrogen compound is water-insoluble.

8. A method as set forth in claim 7 wherein said nitrogen compound is an alkoxyamine wherein the alkoxy chain has from 2 to about 15 alkoxy groups.

9. A method as set forth in claim 8 wherein said alkoxyamine is an ethoxyamine.

10. A method as set forth in claim 5 wherein the reaction is conducted at a temperature of from about 70° C. to about 100° C.

11. A method for inhibiting copper and aluminum corrosion in a petroleum-based fuel system, comprising the step of adding to a petroleum-based fuel between about 5 ppm and about 1000 ppm of a corrosion inhibitor comprising an oil-soluble adduct of a triazole and a basic nitrogen compound selected from the group consisting of polyamines, alkoxyamines and aryloxyamines, said adduct being resistant to water extraction.

12. A method as set forth in claim 11 wherein said nitrogen compound is a water-insoluble amine.

13. A method as set forth in claim 12 wherein said amine is an alkoxyamine having from about 2 to about 15 alkoxy groups.

14. A method as set forth in claim 13 wherein said triazole is tolyltriazole.

15. A method as set forth in claim 12 wherein said triazole is tolyltriazole and said nitrogen compound is bis(hydroxyethyl)cocoamine.

16. A method as set forth in claim 12 wherein said triazole is tolyltriazole and said nitrogen compound is bis(hydroxyethyl)octadecylamine.

17. A method as set forth in claim 12 wherein said triazole is tolyltriazole and said nitrogen compound is bis(hydroxyethyl)2-ethylhexylamine.

18. A method as set forth in claim 12 wherein said triazole is tolyltriazole and said nitrogen compound is bis(hydroxyethyl)oleylamine.

19. A composition as set forth in claim 1 wherein said nitrogen compound is selected from the group consisting of alkoxyamines and aryloxyamines.

* * * * *